US005287815A

United States Patent [19]

Gross

[11] Patent Number: 5,287,815

[45] Date of Patent: Feb. 22, 1994

[54] COMPUTER WORKSTATION

[76] Inventor: Milton Gross, 34 Elmore Rd., Rochester, N.Y. 14618

[21] Appl. No.: 879,392

[22] Filed: May 7, 1992

[51] Int. Cl.[5] ..... A47B 35/00

[52] U.S. Cl. ..... 108/50; 312/208.1

[58] Field of Search ..... 108/50, 6, 7, 9, 5, 108/10, 147, 138, 92, 93, 96; 248/242, 243, 917, 919, 920, 921, 922, 923; 312/208.1, 195, 196

[56] References Cited

U.S. PATENT DOCUMENTS

| | | | |
|---|---|---|---|
| 369,124 | 8/1887 | Powers | 108/10 |
| 2,041,772 | 5/1936 | Lundquist | 108/10 |
| 2,931,685 | 4/1960 | Butler | 108/9 X |
| 4,616,218 | 10/1986 | Bailey et al. | 248/920 X |
| 4,725,106 | 2/1988 | Shields et al. | 108/7 X |
| 5,041,770 | 8/1991 | Seiler | 108/7 X |
| 5,044,284 | 9/1991 | Gross . | |
| 5,118,172 | 6/1992 | Ugalde | 108/6 X |
| 5,174,224 | 12/1992 | Nagy et al. | 108/6 X |
| 5,199,773 | 4/1993 | Price, Jr. et al. | 312/208.1 X |

FOREIGN PATENT DOCUMENTS

| | | | |
|---|---|---|---|
| 2592288 | 7/1987 | France | 108/7 |

OTHER PUBLICATIONS

ANSI/HFS 100-1988 (Feb. 4, 1988).

*Primary Examiner*—Jose V. Chen

*Attorney, Agent, or Firm*—Martin Lu Kacher

[57] ABSTRACT

A computer workstation for supporting and positioning a computer and/or its video display terminal and its keyboard at optimal ergonometric position with respect to the arms, wrists, fingers, eyes and posture of the user. Keyboard is supported on a keyboard shelf having depending side members from which arm and foot members extend. The workstation has side panels providing leg members on which are racks having two rows of vertically spaced slots. The row of slots nearest the keyboard shelf receive the tips of the side member-mounted arms which can be hooked and captured in channels in the slots in which they are received. The assembly forms a mechanical couple which, under the force of gravity, rotates about the arm member's tips until the foot member bears against an edge presented by the rack. An arm rest extends laterally across the shelf and is attached to the side members of the shelf assembly for translational and rotational motion so as to position the arm and wrist of the user with respect to the keyboard. A terminal may be located on a table behind the keyboard shelf. Within the front edge of the table nearest and facing the user is a transverse pivot rod whose ends extend beyond the sides of the table. The ends of the pivoting rod enter slots in the other row of slots farthest from the keyboard shelf. The opposite end of the table is supported by a belt. A screw feed mechanism lengthens and shortens the belt so as to select the inclination of the table by enabling the table to rotate about the axis of the rod.

23 Claims, 7 Drawing Sheets

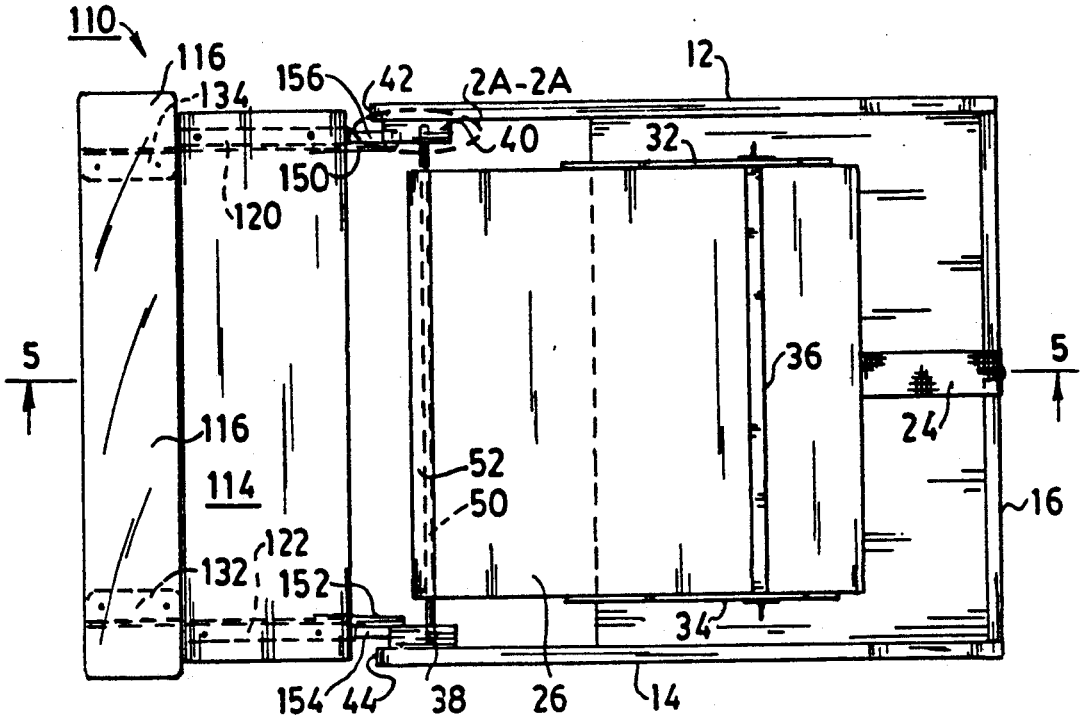
FIG. 2
FIG. 2A
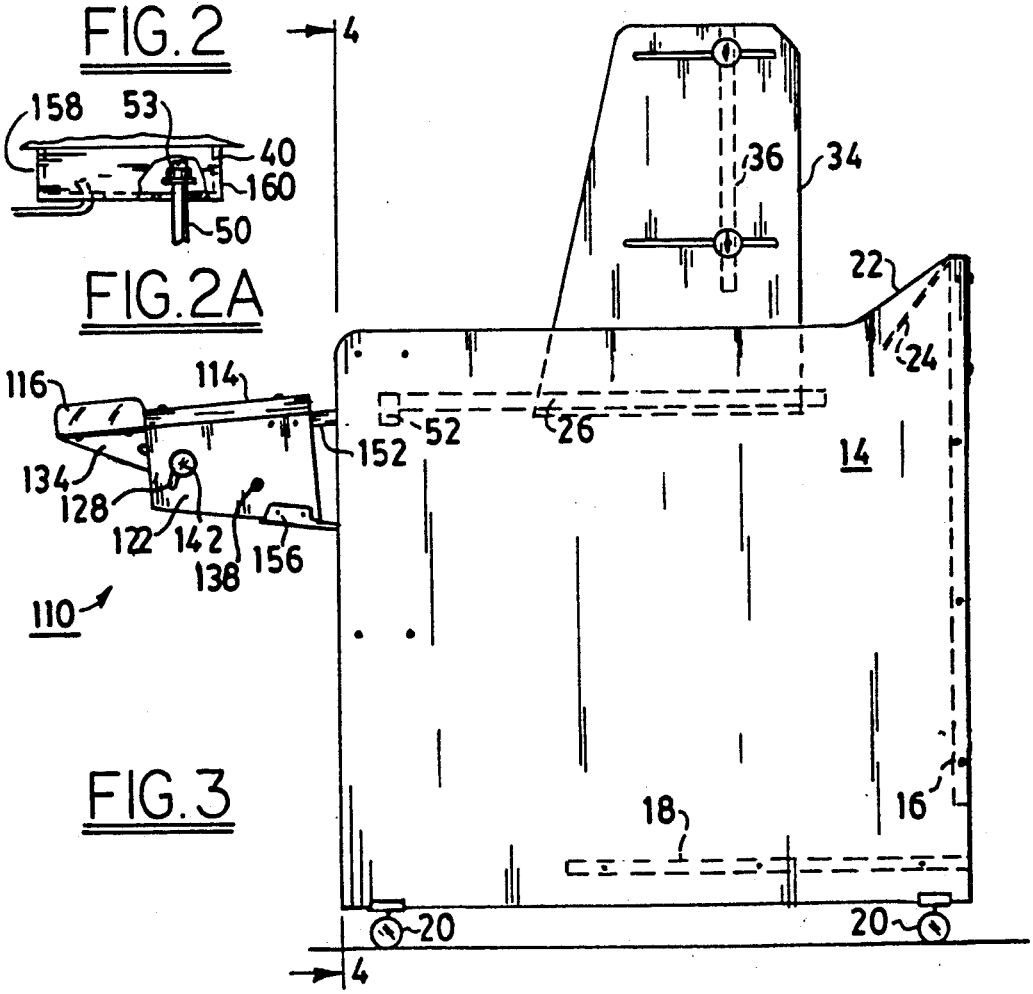
FIG. 3

COMPUTER WORKSTATION

DESCRIPTION

The present invention relates to workstations and particularly to workstations for supporting a computer and/or its video display terminal and its keyboard. By having operator-performed adjustments, the workstation allows the operator to fit the workstation to the ergonomic demands of his body, thereby, reducing and minimizing Cumulative Trauma Disorders (CTD).

This invention is an improvement upon the workstation described in U.S. Pat. No. 5,044,284 issued Sep. 3, 1991 to the present inventor.

It is an object of this invention to provide an improved computer workstation with sufficient operator-performed adjustability to meet and exceed the recommended ranges and guidelines of the American National Standard/Human Factors Society document ANSI/HS 100. This improved workstation minimizes CTD and achieves, in an improved way, the same objects and advantages as disclosed in U.S. Pat. No. 5,044,284.

It is a further object of the invention to provide an improved computer workstation which is convenient to use by facilitating adjustment in elevation, of a shelf on which the keyboard of the computer terminal may be located.

It is a further object of the invention to provide an improved computer workstation which has an rm rest adjustable in both horizontal and vertical directions to provide support for the wrist, forearm or elbow at the option of the operator.

It is a still further object of the invention to provide an improved computer workstation in which the inclination of a table on which the computer display terminal and/or the computer may be located and adjusted by means of an improved mechanism.

Briefly described, a workstation for supporting a computer and/or video display terminal and its keyboard, which embodies the invention, has a table on which the display and/or the computer may be disposed, with the screen facing the user. The table is mounted on members, called "leg members" herein, which extend vertically and are laterally spaced from each other. A shelf assembly, on which the keyboard can be disposed in ergonomically optimal relationship with the user's arm, wrist and fingers, is also supported on the leg members in front of the table. The assembly has a shelf from which side members depend. Arm and foot struts (also called arm and foot members) extend from the end of the side member which faces the table. The leg members have racks thereon with slots in which the arm members are located so as to adjust the elevation of the shelf. The arm members, the shelf and the side members define a mechanical couple such that the force of gravity rotates the assembly about the tips of the arm members which are captured in the rack slots, preferably at the bottom of channels which prevent the arms from leaving the selected slots. The assembly rotates until the foot members engage and bear upon the edges of the racks. The assembly includes a bar providing an arm rest extending laterally across the end of the shelf adjacent to the operator. The rest is attached by brackets which are movably connected to the side members, preferably by a slot arrangement which enables translation of the rest to locate it toward or away from the user, as well as rotation of the rest so as to raise it incrementally up and down between the elevational positions defined by the slots in the rack The shelf assembly is therefore readily adjustable ad removably positionable at selected elevations by the user so as to enable the user to find the position which the user finds most comfortable and convenient when seated to operate the terminal.

The table is also mounted in the rack by means of a rod which extends laterally across the front end thereof (the end which faces the user). The rack, which receives the rod, preferably has inclined slots facing the slots which hold the keyboard shelf assembly. The rear end of the table is supported by a belt mechanism which is shortened or lengthened to enable the table to tilt about an axis of rotation defined by the rod in the rack slots in the manner described in the above referenced U.S. Pat. No. 5,044,284. The mechanism for adjusting the length of the belt makes the adjustment of the inclination more convenient. The mechanism includes a threaded rod mounted to the bottom of the table, which rotates bout an axis extending between the forward and rear ends of the table. A nut is translated when the rod is rotated, preferably by a motor driven mechanism provided by a conventional electric screwdriver, which is coupled o the rod at one end thereof. The nut carries a pulley which defines a loop of the belt below the table. The loop is lengthened or shortened depending upon the direction in which the rod is rotated thereby adjusting the inclination of the table.

The foregoing and other objects, features and advantages of the invention as well as the presently preferred embodiment thereof, will become ore apparent from a reading of the following description in connection with the accompanying drawings in which:

FIG. 2 is a plan view of the workstation shown in FIG. 1;

FIG. 2A is an enlarged view of the portion of FIG. 2 in the circle defined by the dash line, marked 2A—2A;

FIG. 3 is a side view of the workstation shown in FIG. 1;

FIG. 10 is a fragmentary sectional view, similar to FIG. 8, showing the shelf assembly in stowed position thereby clearing the area in front of the workstation for cleaning, passage and the like.

Figure 1:
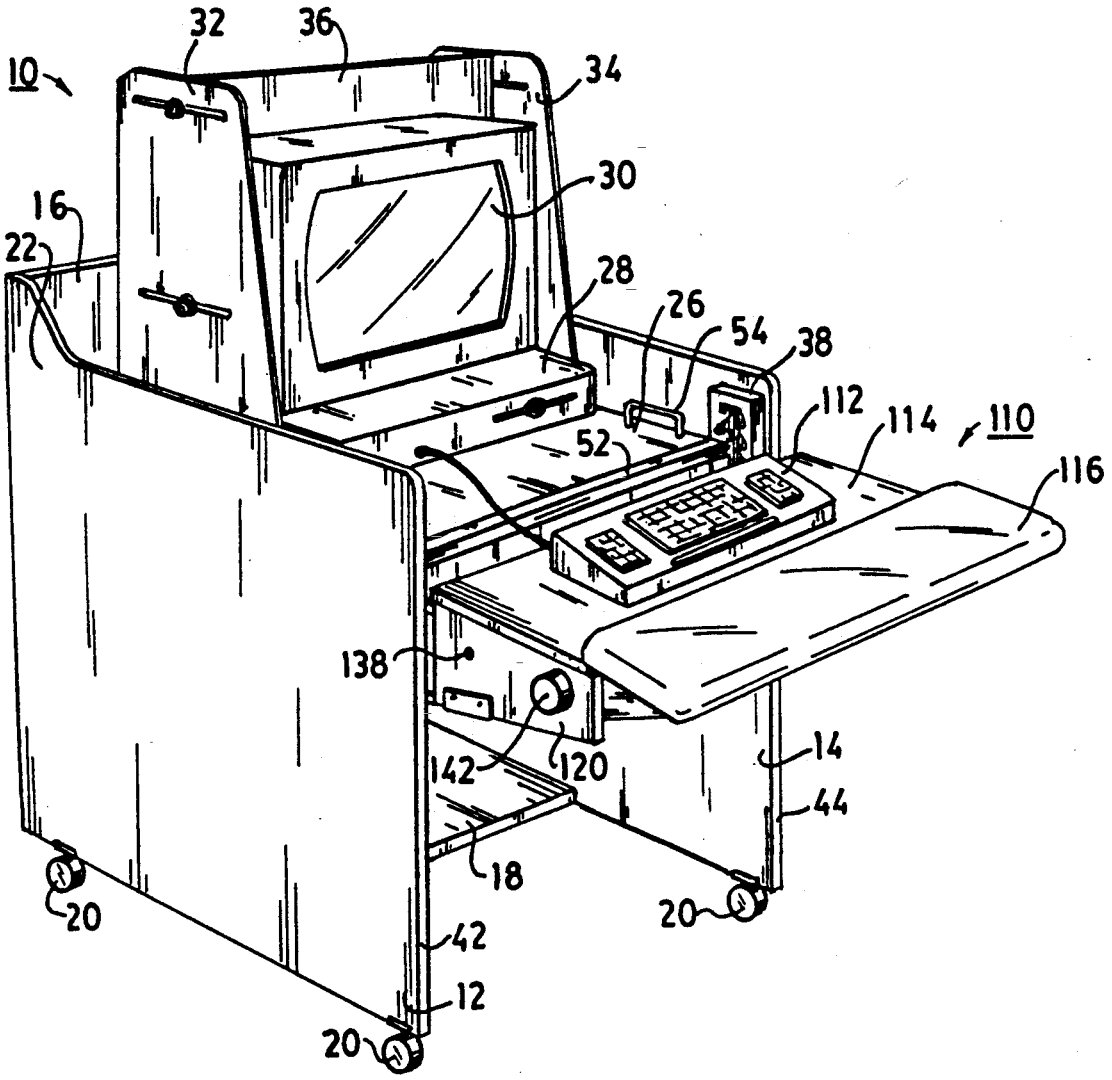
FIG. 1 is a perspective view of a computer workstation in accordance with presently preferred embodiment of the invention.
Figure 5:
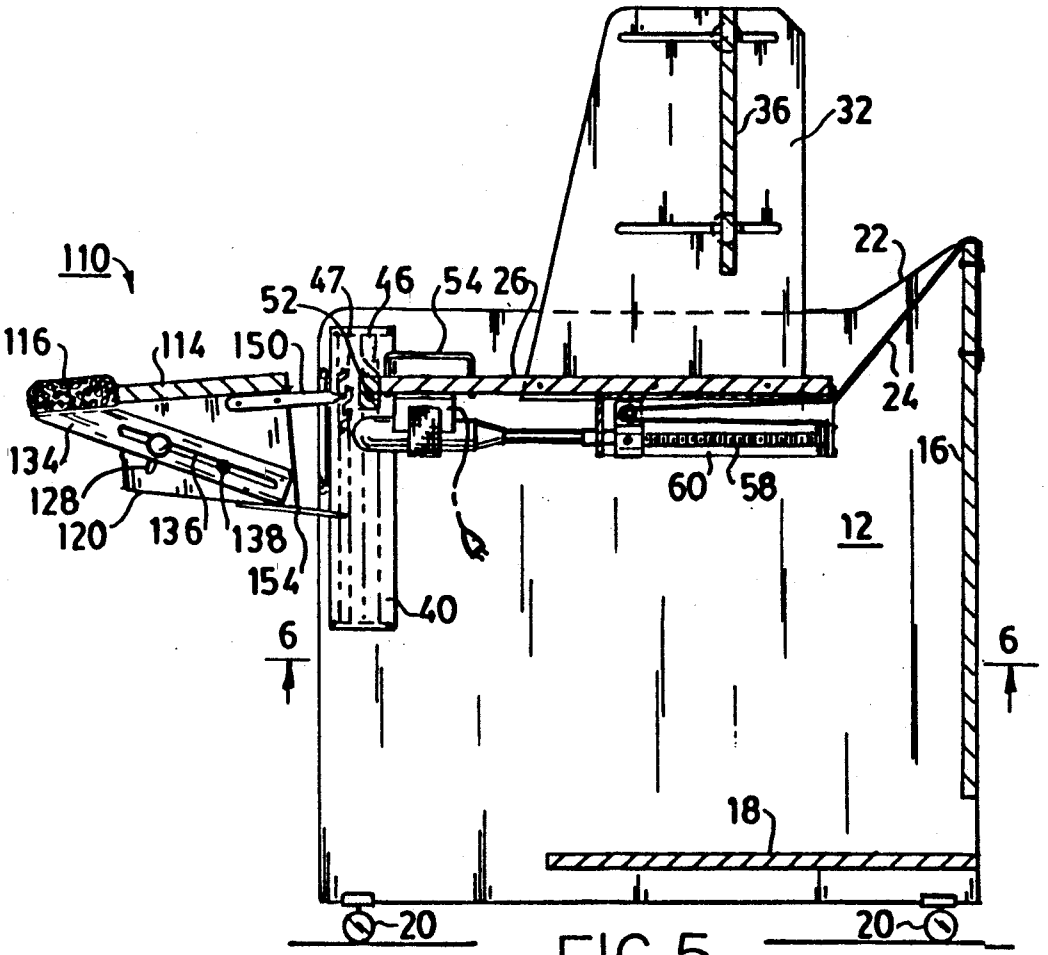
FIG. 5 is a sectional view taken along the line 5—5 in FIG. 2 when viewed in the direction of the arrows.
Figure 4:
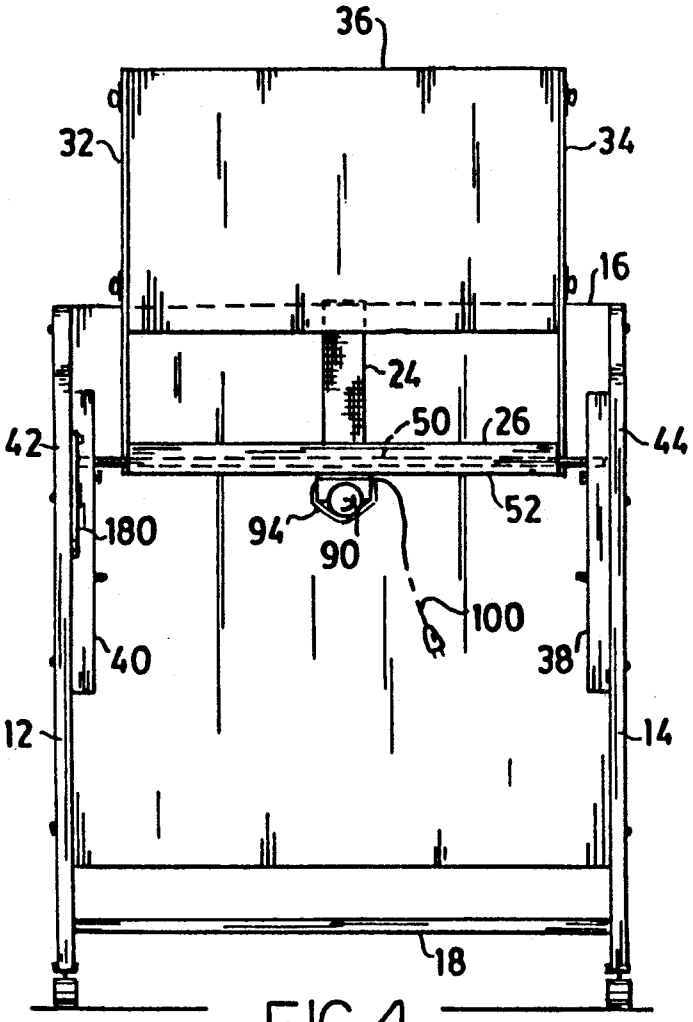
FIG. 4 is a front view taken along the line 4—4 in FIG. 3 when viewed in the direction of the arrows.
Figure 6:
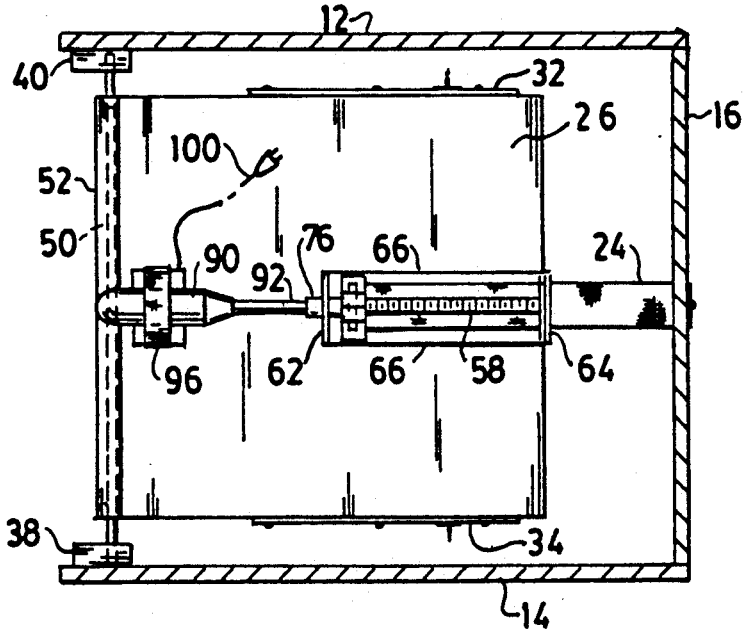
FIG. 6 is a sectional plan view taken along the line 6—6 in FIG. 5 when viewed in the direction of the arrows.

Referring to FIGS. 1 through 4 there is shown a computer workstation 10 having a frame of panels, namely laterally spaced side panels 12 and 14, a back panel 16 and a bottom panel 18. The panels 12 and 14 constitute leg members of the station 10 and may be mounted on rollers 20, if the workstation is to be moved from place to place. The rollers are optional and the leg members 12 and 14 may be placed directly on the floor or may have glides slightly spacing the station 10 from the floor. The panels 12 to 18 and the other panels ad the shelves and tables of the station 10 may be made or particle board and assembled together using metal insert dowels and bolts as described in connection with FIGS. 14 through 16 of the above referenced U.S. Pat. No. 5,044,284 (hereinafter "284"). The rear corners 22 of the leg member panels 12 and 14 are raised, so as to raise the edge of the back panel to a desired height which facilitates the attachment of a belt 24 which adjusts the inclination of a table 26 on which the computer 28 and its display 30 are disposed. See the 284 patent for an earlier embodiment using table inclination adjusting belt. Side panels 3 and 34 extend upwardly from the top of the table 26. A movable vertical panel 36 backs the display and is adjustable to locate the display forwardly or rearwardly on the table 26. The design use and purpose of the panels 32, 34 and 36 and the adjustment of the panel 36 is described in the 284 Patent.

Racks 38 and 40 are disposed on the leg members 12 and 14 adjacent to the front or forward edges 42 and 44 of the leg members 12 and 14 and are parallel therewith. These racks 38 and 40 are box-like structures of sheet metal (see FIG. 2A) having opposed columns 46 and 47 each containing a plurality of slots having entrances along a central vertical opening 48 (see FIG. 8). The column 46 has a plurality of inwardly inclined slots which set the vertical elevation of the table, when a rod 50 which projects laterally from the sides of the table is disposed in a slot selected in accordance with the desired elevation. The rod 50 is clamped against the forward edge of the table 26 by a block 52 which is screwed into the table 26. The ends of the rod 50 are threaded a short distance along the axis of the rod to receive flanged cap screws 53 (see FIG. 2A) which control the lateral movement of the table 26, when the ends of the rod 50 are disposed in the slots of the column 40 at the desired elevation of the table 26.

Handles 54 are grasped by the use who can pull the table upwardly and forwardly out of the slots in which the rod 50 is disposed into the central vertical opening 48 of the racks 38 and 40. The table may then be raised or lowered, while the rear edge of the table is supported by the belt 24, and placed in a different slot in the column of slots 46. The table is shown located in phantom and in full in different ones of the slots of the column of slots 46.

Figure 7:
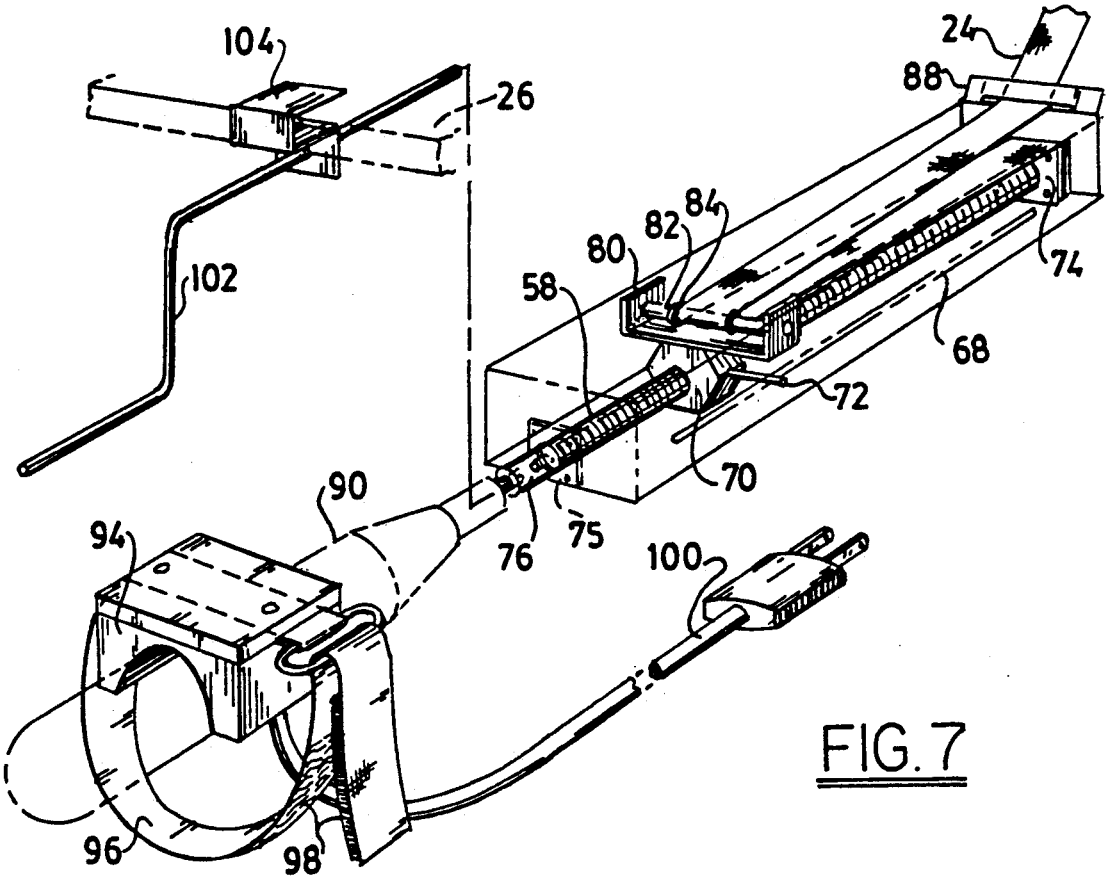
FIG. 7 is a perspective diagrammatic view illustrating the location of the mechanism shown in FIGS. 4 and 5 for adjusting the inclination of the table on which the computer and its display terminal are disposed.
Figure 7A:
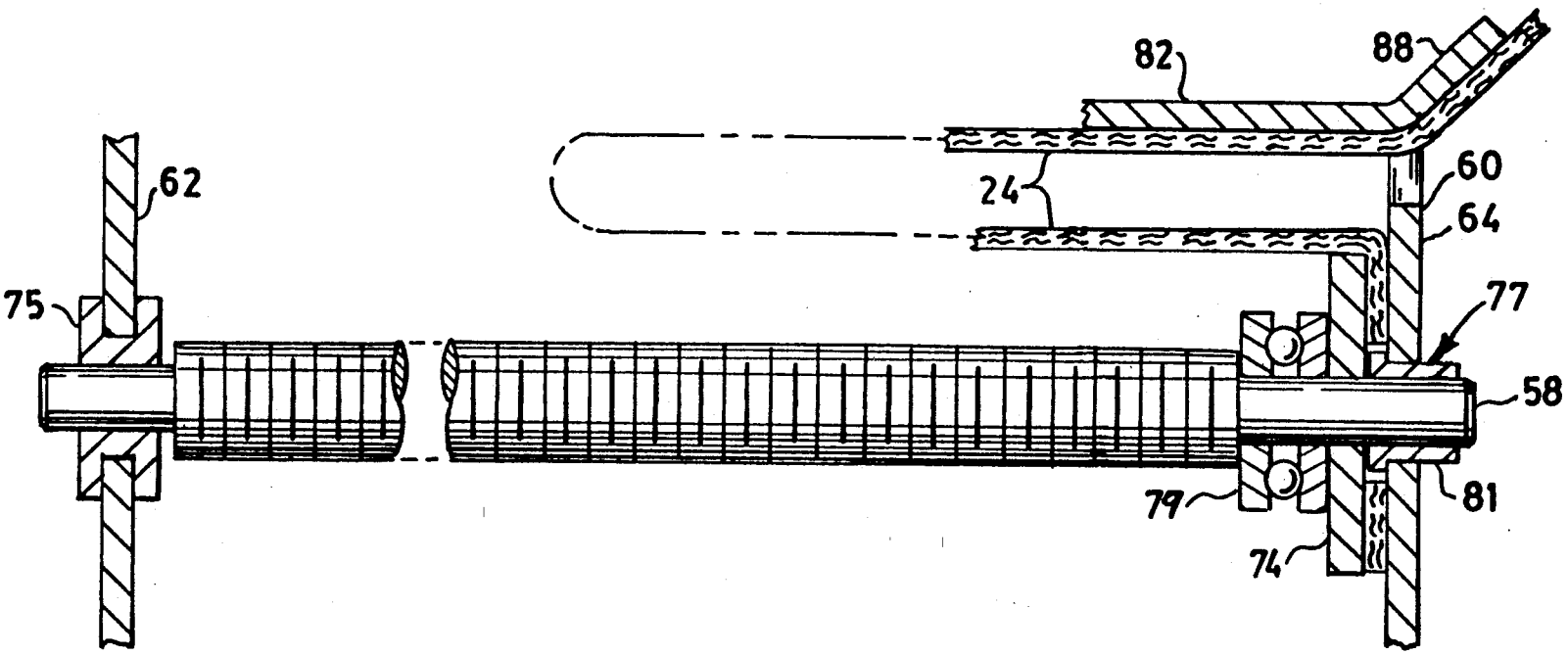
FIG. 7A is an enlarged, fragmentary view of a part of the adjustment mechanism.

The inclination of the table 26 ad therefore of the display 30, to prevent light from overhead lamps from being reflected from the screen into the eyes of the user and interfere with the user's view of what is displayed on the screen, and otherwise for ergonomic considerations or operator convenience, is obtained by adjusting the length of the belt 24. The adjustment mechanism depends from the bottom of the table 26. As shown in FIGS. 4, 5, 6 and 7, this mechanism utilizes a threaded rod 58 which is rotatable along an axis (the axis of the rd 58) which extends between the forward and rear edges of the table 26, approximately midway between the sides of the table. This rod is supported and journaled in a frame 60 having a top which is screwed into the bottom of the table, forward and rear ends 62 and 64 and sides 66. The sides of the box are closed and one of the sides has a guide slot 68 extending parallel to the axis of rotation of the rod 58. The rod is preferably provided with an Acme-type thread on which a movable nut 70 is threaded. The nut 70 is restrained against rotation by a pin 72 (see FIG. 7) which extends into the slot 68. The ends of the rod are journaled for rotation and against thrust by bearings, such as double-flanged plastic bearings 75, 77, which capture and journal the ends of the rod. A clamp plate 74 positions a bearing 77 assembly (FIG. 7A) including a floating thrust bearing 79 and a plastic locating bearing 81, in the rear end 64 of the frame 60. A coupling 76 is screwed into the forward nd of the threaded rod 58, in a forward portion 78 thereof which is unthreaded, and acts as a stop for the nut 70 at the forward end of its travel along the threaded rod 58.

A bracket 80 is mounted on the nut 70 and has a pin 82 extending perpendicularly to the axis of rotation of the rod 58. A crowned roller 84 is journaled on the pin 82 and provides a pulley around which the belt 24 is looped. A loop 59 of the belt is disposed in the frame 60. A tab 88 is punched out of the ear end 64 of the frame 60 and provides a belt guide on which the belt 24 rides. The rear end of the belt is clamped by screws 157 or a clamp plate onto the back Panel 16. The opposite end of the belt is clamped by the clamp plate 74 which also clamps the rear bearing for the rod 58.

Figure 8:
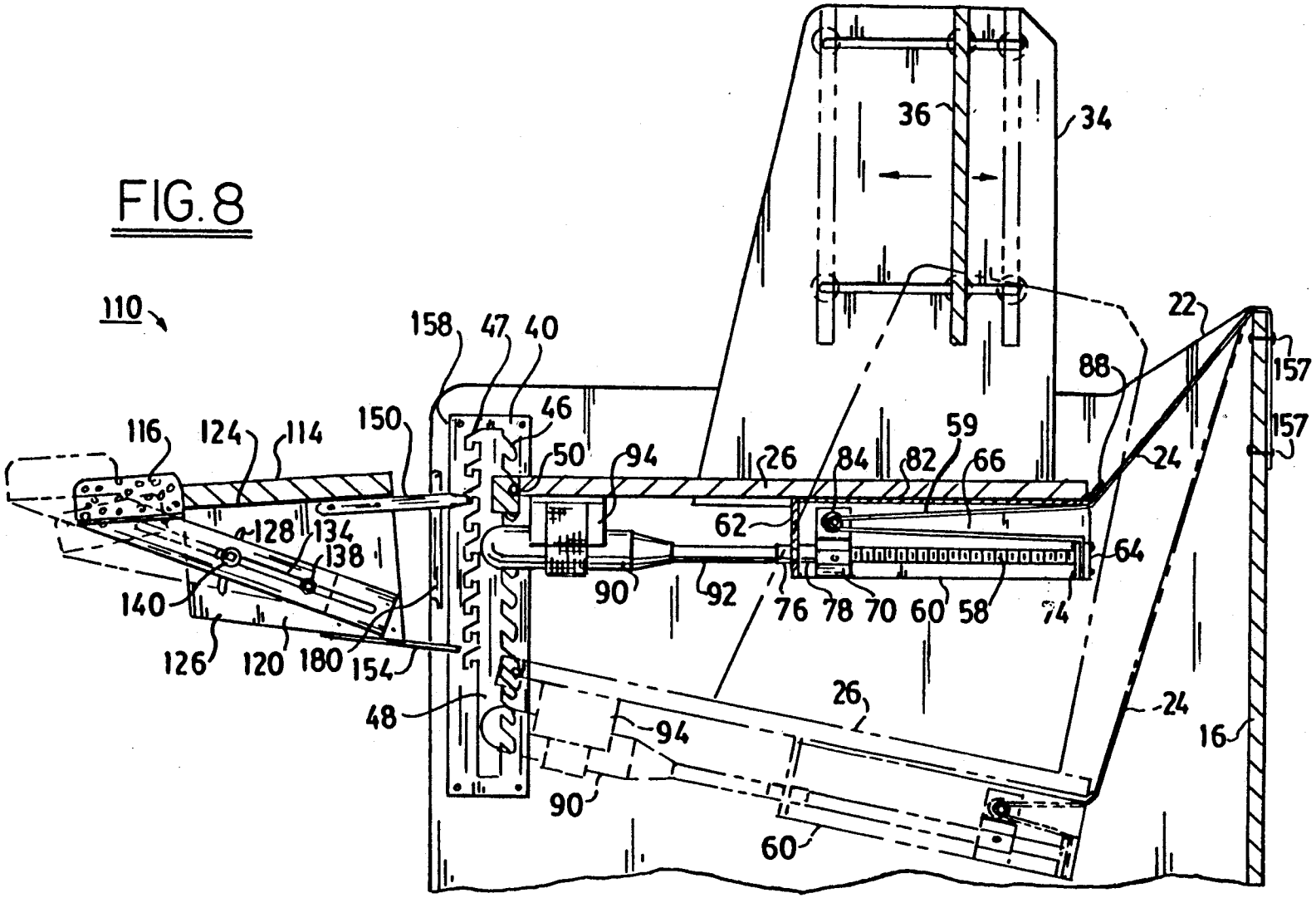
FIG. 8 is a fragmentary, sectional view, similar to that shown in FIG. 5, but enlarged and showing the location of the rest of the keyboard shelf assembly and the computer support table in different positions.
Figure 9:
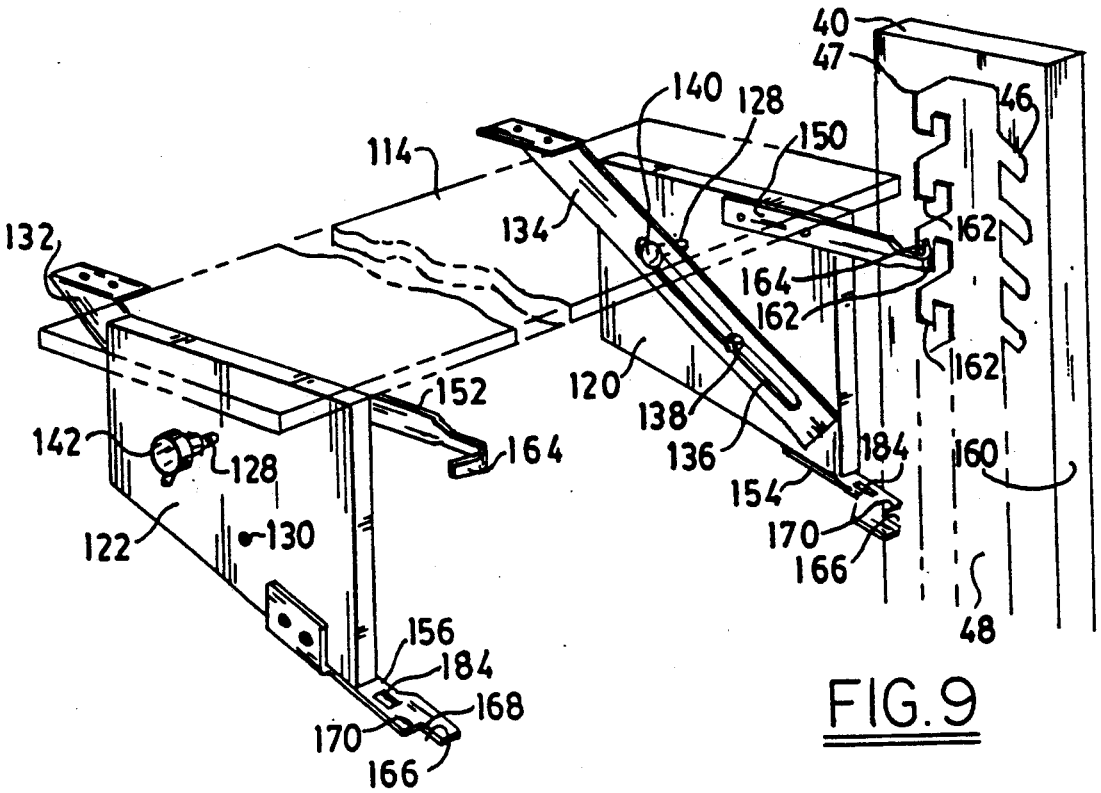
FIG. 9 is a perspective view illustrating the keyboard shelf assembly and its location in the slots in the rack shown in FIG. 8.

The shaft is preferably rotated by an electric screwdriver 90 of conventional design. The screwdriver has a shank 92 which fits into a hex-shaped fluted or other nonsymmetrical hole in the forward end of the ouputting 76. The screwdriver 90 is attached and plugged into its charger unit 94 which is connected to the bottom of the table 26. A strap 96 having a Velcro strip holds the body of the screwdriver 90 in place. There is sufficient friction between the body of the screwdriver 90 and the strap and also sufficient restraint (there being substantially no axial force on the screwdriver) by virtue of the connectors by which the handle 90 plugs into the charger 94, so as to maintain the screwdriver in place under the table 26. The screwdriver charger may be plugged into a wall receptacle by means of a linecord and plug 100. The screwdriver has a switch whereby it may be started, rotated in clockwise or counterclockwise directions, and stopped. Rotation of the screwdriver moves the nut and the pulley 84 thereby increasing or decreasing the size of the loop 59 in the frame 60, as shown in FIG. 8 and the loop is lengthened. The rear end of the table is tilted upwardly and when the loop is shortened the rear end tilts downwardly thereby readily enabling the inclination of the table 26 to be adjusted. The computer and display 28 and 30 cannot fall off the table because they are stopped by the back panel 36 and the panels 54 (see FIG. 1).

Instead of an electric screwdriver, another motor, such as a DC motor with a gearbox may be used to rotate the screw 58 and adjust the length of the loop of the belt, thereby changing the inclination of the table 26. In the event that it is desired to reduce the cost of the station, a crank 102 mounted o a bracket 104 attached to the table has a hex, fluted or otherwise nonsymmetrical end which enters into the coupling 76 and may be used to manually turn the screw 58 and adjusts the inclination of the table 26.

FIG. 1 shows the shelf assembly 110 for the keyboard 112 and possibly also a mouse (not shown) which is connected to the computer 28. The shelf assembly has a panel 114 which extends laterally across the front of the table 26 and between the leg members 12 an 14. Extending laterally across the forward edge of the shelf 114 is a bar covered by soft (e.g., foam or fabric) material which provides a rest 116 for the arm or wrist of the user. The user may stand or be seated in front of the workstation. Ergonomic considerations require the rest to be at a certain height and elevation, at a certain distance from the keyboard 112 and at a certain inclination in order to reduce strain on the arm, wrist and fingers of the user. All such adjustments are readily made in the shelf assembly 110.

The construction of the shelf assembly and the means for adjustment thereof in elevation, distance of the rest from the keyboard and in inclination ill become more apparent from FIGS. 2, 3, 5, 8, 9 and 10. The shelf 114 has depending therefrom and attached thereto by the bolt and dowel arrangement discussed above, a pair of side members 120 and 122. These members are plates, identical in shape and have top and bottom edges 124 and 126. The top edges 124 are flat to facilitate attachment to the bottom of the shelf 114. The bottom edge 126 is inclined to the top edge 124 so that when the edges are projected they make an angle of about thirty degrees. The side member plates 120 and 122 have arcuate slots 128 therethrough, as well as holes 130 (see FIG. 9).

The rest is attached to brackets 132 and 134 having slots 136. The brackets are disposed on the inside of the side members 120 and 122. A bolt 138 extends through the side members and the slot 136. The bolt has an elastic stop nut so as to provide clearance and enable the brackets 132 and 134 to translate forwardly and rearwardly with respect to the shelf 114. Other bolts 140 extends through the slot 136 and the arcuate slot 128. Knobs 142, threaded on these bolts 140, are disposed on the outside of the panels 120 and 122 and serve to clamp the brackets 132 and 134 when tightened against the side members 120 and 122. When the knobs are loosened, the brackets and the rest 116 can move in translation and can also rotate about the arcuate path defined by the slots 128. As shown in FIG. 8, both the translational position (away from and toward the shelf 114) and the tilt of the rest 116 may readily be adjusted.

In order to releasably support the assembly 110 at elected elevations, the columns 47 of slots in the racks 38 and 40 are used. Pairs of arm members or struts 150 and 152 and foot members or struts 154 and 156 are attached to the side members 120 and 122 and project rearwardly towards the main portion of the workstation having the racks 38 and 40. These racks have front and rear spacers or flanges which may be formed by bending sheets of metal, which can be punched out to define the slots 46, 47 and the opening 48. See FIG. 9. These spacers define front and rear edges 158 and 160 of the racks 38 and 40. The slots in the column 47 have entrance portions from the opening 48 which lead to downwardly extending channels 162. In effect, these slots are hook-shaped with the hooks extending upwardly. These hooks receive hooked tips 164 of the arm members or struts 150 and 152. The sides of the channels as well as the bottoms thereof act as stops and also provide journals for the tips 164 of the arm members or struts 150 and 152.

The foot members or struts 154 and 156 have L-shaped notches 166 with sides 168 and steps 170. The corners defined by the slotted face and the front edges 158 of the racks 38 and 40 are complimentary to these notches 166. The steps 170 then bear against the edges 158 while their lateral position is stabilized by the sides 168 of the notches 166. In effect, the arm and foot struts, interconnected by the shelf 114 and the side members 120 and 122, define a mechanical couple. The assembly 110 rotates about the pivot defined by the tips of the arm struts 150 and 152 under the force of gravity, until the foot members bear against the front edges of the racks. The assembly 100 is therefore releasably engaged in the racks 38 and 40. The user may merely pivot the assembly and move it rearwardly toward the table 26 until the hooked tips enter the opening 148. Then, the shelf assembly can be raised or lowered to obtain the desired elevation. Once the elevation is set, the rests 116 are translated and rotated and then clamped in place with the knobs 142 at the desired position which is ergonomically optimum for the user.

Figure 10:
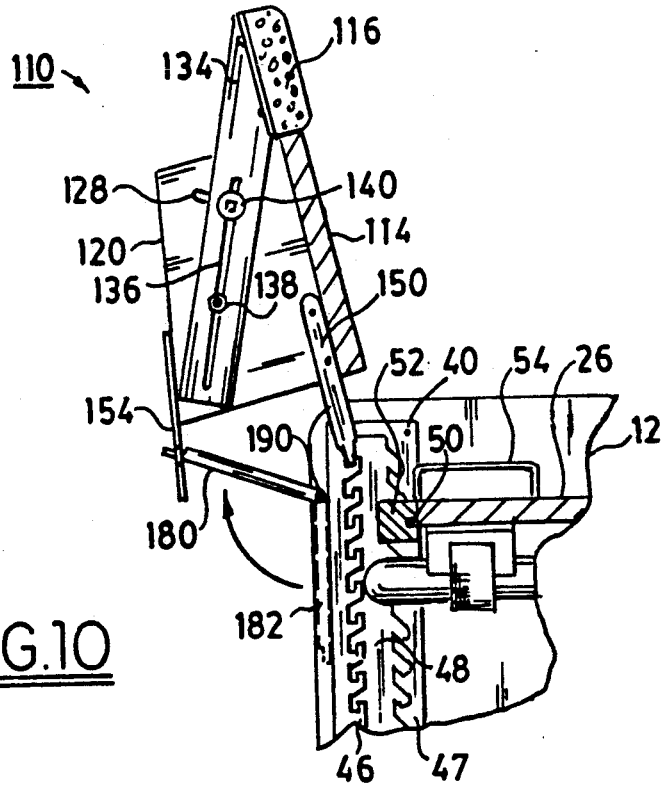

The ability to pivot and rotate the assembly 110 enables it to be stowed in a position where it clears the passageway in front of the workstation. The stowed position of the assembly is shown in FIG. 10. A link 180 is provided which hangs on a pivot 190 normally in the position shown by the dash lines 182. The foot members are provided with slots 184 into which a tip of the link 180 may be disposed while the arm members 150 and 152 are in the uppermost slot in the column 47 of slots. Then the link 180 acts as a brace holding the assembly 110 in stowed position.

From the foregoing description, it will be apparent that there has been provided an improved computer workstation. Variations and modifications in the herein described workstation, within the scope of the invention, will undoubtedly suggest themselves to those skilled in the art. For example, the leg members can be part of the pedestals of a desk in which the workstation is integrated. Accordingly, the foregoing description should be taken as illustrative, and not in a limiting sense.

I claim:

1. In a workstation having a table for supporting a computer display terminal with a screen facing a user, said table being mounted on vertically extending leg members, a shelf assembly on which a keyboard can be disposed in ergonomically optimal relationship with the user's arm, wrist and fingers, said assembly comprising a shelf, side members depending from said shelf, said side members having rear and forward ends respectively facing away from and towards said table, arm and foot members projecting forwardly, from each of said rear ends, said arm members being above said foot members, racks along said leg members, said racks having pluralities of vertically spaced slots in which said arms are selectively captured to locate said shelf at different elevations and to define pivots for said assembly, said racks having forwardly facing edges against which said foot members bear, said assembly being releaseably retained by said racks, and said arm and foot members defining mechanical couples enabling said assembly to rotate about said pivots under the force of gravity until stopped by said forwardly facing edges of said racks upon engagement thereof by said foot members, a bar providing a rest for the user's wrist or arm, said bar extending laterally along said shelf, laterally spaced brackets supporting said rest and projecting forwardly along said side members, and means for connecting said brackets to said side members and enabling movement of said rest forwardly and rearwardly in translation and rotationally in upward and downward directions to selected positions with respect to said shelf.

2. The invention as set forth in claim 1 wherein said racks have a second plurality of slots, said table having opposite ends extending laterally between said leg members, at least one rod connected to said table along one of said opposite ends and having projections receivable in different ones of said second pluralities of slots for pivotally supporting said table at selected elevations, a belt extending across the other of said opposite ends of said table in supporting relationship to said table, a belt length varying mechanism for increasing and decreasing the length of said belt for pivoting said table about said rod to adjust the inclination thereof, which mechanism comprises a threaded rod mounted to said table for rotation about an axis extending between said opposite ends of said table, a nut on said threaded rod movable along said axis as said threaded rod rotates, a pulley journaled on said nut and movable therewith, said belt being fixed to said table at an end of said belt and extending around said pulley, and means for rotating said rod to move said pulley along said axis for shortening and lengthening said belt thereby changing the inclination of said table.

3. The invention according to claim 2 wherein said station has a back member extending laterally between said leg members, said belt being fixedly connected to said back member at an end thereof spaced from the end of said belt which is connected to said table.

4. The invention according to claim 2 wherein said means for rotating said screw is an electric screw driver having a charging unit and a shank, said charging unit being attached to said table, and said screw driver being attached to said charging unit with its said shank coupled to said screw.

5. The invention as set forth in claim 2 wherein said table has a top on which said terminal can be disposed and a bottom, a frame having a top attached to said table at the bottom of said table, said frame having opposite ends depending from said top and one side extending between said opposite ends, said screw being journaled in said ends of said frame, said side having a slot extending between said ends of said frame, a pin extending from said nut into said slot to prevent rotation of said nut and restrict said nut to movement along said axis, one of said ends of said frame being disposed near said end of said table across which said belt extends, said end of said belt which is fixed to said table being attached to said one end of said frame whereby said belt forms a variable length loop in said frame about said pulley.

6. The invention as set forth in claim 5 wherein said one of said ends has a tab extending outwardly from said frame about which said belt bears and on which said belt is guided.

7. The invention as set forth in claim 1 wherein said racks are provided by plates in which said slots are disposed, said plates having flanges extending laterally therefrom towards said leg members, said flanges defining said edges and corners with said plates, said flanges spacing said slotted plates from said leg members, said foot members having notches in the ends thereof which face forwardly and which receive said corners to brace said foot members against said edges of said racks.

8. The invention as set forth in claim 1 wherein said racks are provided by plates in which said slots are disposed, said plates being spaced from said leg members, said arms having forward tips, said forward tips being hooked to extend around said plates when in said slots.

9. The invention as set forth in claim 1 wherein said arms have forward tips, and said slots are defined by openings opposite to said edges and channels extending downwardly from said openings in which said tips are received.

10. The invention as set forth in claim 9 wherein said channels have rearwardly extending edges and said tips are curved to hook around said rearwardly extending edges of said slots.

11. The invention as set forth in claim 1 wherein said foot members have slots therein, a link pivotally mounted at one end thereof to one of said leg members, said link having a finger extending to a step at the ends thereof opposite to said one end of said link, said link defining a brace when said fingers are disposed in said slots with said steps bearing against said foot members and when said shelf assembly is pivoted rearwardly about said pivots into stowed position.

12. The invention as set forth in claim 1 wherein said connecting means are provided by slots in said brackets, first and second pins extending through said side members and through said slots, further slots in said side members through which said second pins extend, said side member slots defining arcuate paths along which said second pins are movable enabling the rotational movement of said rest with said brackets, and means associated with said second pins for clamping said brackets and said side members together when said rest is translated and rotated to selected positions.

13. In a workstation for supporting a computer display terminal on a table located between laterally spaced leg members on which racks having a plurality of vertically spaced slots are disposed, said table having opposite ends extending laterally between said leg members, a mechanism for adjusting the elevation and inclination of said table which comprises at least one rod connected to said table along one of said opposite ends and having projection received in different ones of said second pluralities of slots for pivotally supporting said table at selected elevations, a belt extending across the other of said opposite ends of said table in supporting relationship to said table, a belt length varying mechanism for increasing and decreasing the length of said belt for pivoting said table about said rod to adjust the inclination thereof, which mechanism comprises a threaded rod mounted to said table for rotation about an axis extending between said opposite ends of said table, a nut on said threaded rod movable along said axis as said threaded rod rotates, a pulley journaled on said nut and movable therewith, said belt being fixed to said table at an end of said belt and extending around said pulley, and means for rotating said rod to move said pulley along said axis for shortening and lengthening said belt thereby changing the inclination of said table.

14. The invention according to claim 13, wherein said station has a back member extending laterally between said leg members, said belt being fixedly connected to said back member at an end thereof spaced from the end of said belt which is connected to said table.

15. The invention as set forth in claim 13, wherein said means for rotating said screw is an electric screw driver having a charging unit and a shank, said charging unit being attached to said table, and said screw driver being attached to said charging unit with its said shank coupled to said screw.

16. The invention as set forth in claim 15 wherein said one of said ends has a tab extending outwardly form said frame about which said belt bears and around which said belt is guided.

17. The invention according to claim 16 wherein said racks are provided by plates in which said slots are disposed, said plates having flanges extending laterally therefrom towards said leg members, said flanges defining corners with said plates, said flanges spacing said slotted plates from said leg members, said foot members having notches in the ends thereof which face forwardly and which receive said corners to brace said foot members against said racks.

18. The invention as set forth in claim 17 wherein said channels have rearwardly extending edges and said tips are curved to hook around said rearwardly extending edges of said slots.

19. The invention according to claim 16 wherein said racks are provided by plates in which said slots are disposed, said plates being spaced from said leg members, said arms having forward tips, said forward tips being hooked to extend around said plates when in said slots.

20. The invention as set forth in claim 16 wherein said arms have forward tips, and said slots are defined by openings opposite to said edges and channels extending downwardly from said openings in which said tips are received.

21. The invention as set forth in claim 16 wherein said foot members have slots therein, a link pivotally mounted at one end thereof to one of said leg members, said link having a finger extending to a step at the end thereof opposite to said one end of said link, said link defining a brace when said finger is disposed in said slot with said step bearing against said foot member and when said shelf assembly is pivoted rearwardly about said pivots into stowed position.

22. The invention as set forth in claim 13 wherein said table has a top on which said terminal is disposable and a bottom, a frame having a top attached to said table at the bottom of said table, said frame having opposite ends depending from said top and one side extending between said opposite ends, said screw being journaled in said ends of said frame, said side having a slot extending between said ends of said frame, a pin extending from said nut into said slot to prevent rotation of said nut and restrict said nut to movement along said axis, one of said ends of said frame being disposed near said end of said table across which said belt extends, said end of said belt which is fixed to said table being attached to said one end of said frame whereby said belt forms a variable length loop in said frame about said pulley.

23. In a workstation having a table for supporting a computer display terminal with a screen facing a user, said table being mounted on vertically extending leg members, a shelf assembly on which a keyboard can be disposed in ergonomically optimal relationship with the user's arm, wrist and fingers, said assembly comprising a shelf, side members depending from said shelf, said side members having rear and forward ends respectively facing away from and towards said table, arm and foot members projecting forwardly from each of said ends, said arm members being above said foot members, racks along said leg members, said racks having pluralities of vertically spaced slots in which said arms are selectively captured to locate said shelf at different vertical heights and to define pivots for said assembly, said assembly being releaseably retained by said racks, and said arm and foot members defining mechanical couples enabling said assembly to rotate about said pivots under the force of gravity until stopped by said racks upon engagement thereof by said foot members.

* * * * *